United States Patent [19]

Gunderson

[11] Patent Number: 4,664,291

[45] Date of Patent: May 12, 1987

[54] FEEDER DISPENSER FOR NARROW ELONGATED ITEMS

[76] Inventor: Arnold Gunderson, 3639 N. Spaulding, Chicago, Ill. 60618

[21] Appl. No.: 793,838

[22] Filed: Nov. 1, 1985

[51] Int. Cl.[4] ..... B65D 83/02

[52] U.S. Cl. ..... 221/309; 221/310

[58] Field of Search ..... 221/307–310, 221/284

[56] References Cited

U.S. PATENT DOCUMENTS

| | | | |
|---|---|---|---|
| 570,859 | 11/1896 | Weigand | 221/307 X |
| 846,683 | 3/1907 | Moore et al. | 221/309 X |
| 1,007,547 | 10/1911 | Durrum | 221/309 X |
| 1,476,063 | 12/1923 | Englerth | 221/284 X |
| 3,261,501 | 7/1966 | Capucio | 221/309 X |

FOREIGN PATENT DOCUMENTS

| | | | |
|---|---|---|---|
| 7713036 | 5/1979 | Netherlands | 221/309 |

*Primary Examiner*—F. J. Bartuska

*Attorney, Agent, or Firm*—Alexander, Unikel, Zalewa & Tenenbaum, Ltd.

[57] ABSTRACT

A feeder dispenser for cotton swabs and other narrow elongate consumer items embodies a flexibly lipped discharge port which is open to a restricted mid-portion of the lowermost of a group of gravity-fed items, for individual extraction, by the use of thumb and forefinger, against a mild, resilient resistance.

1 Claim, 6 Drawing Figures

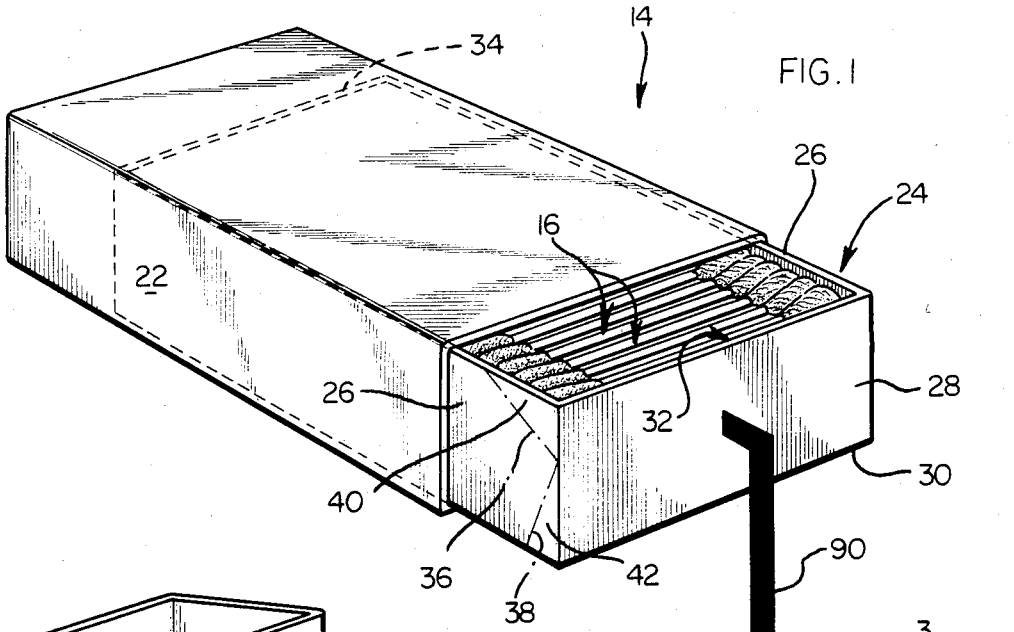
FIG. 1
FIG. 2
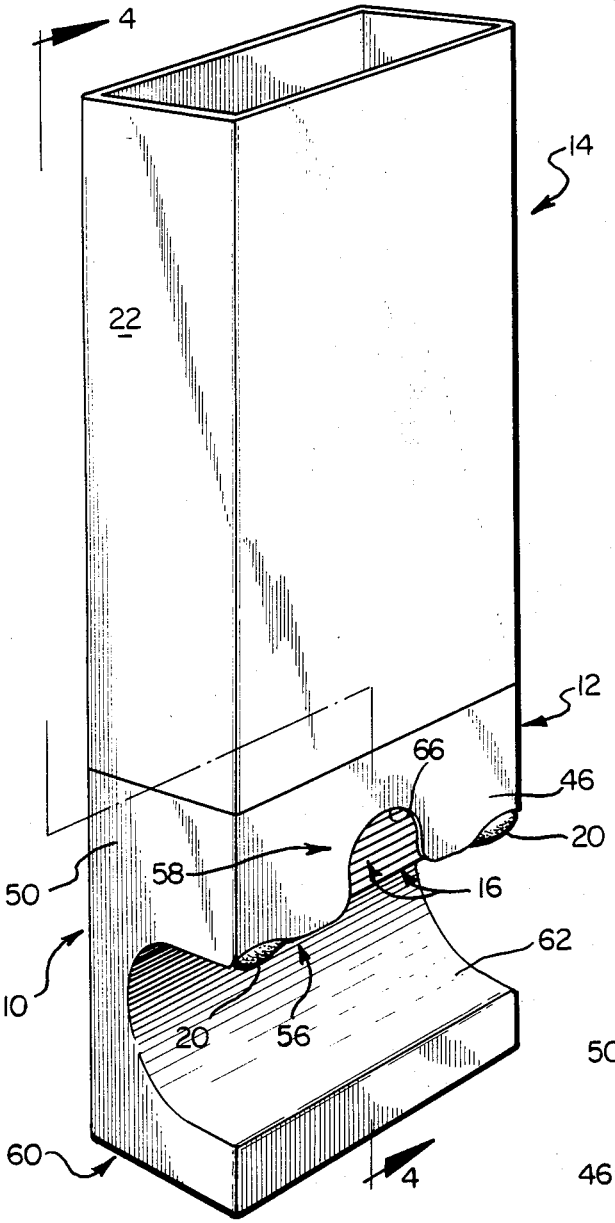
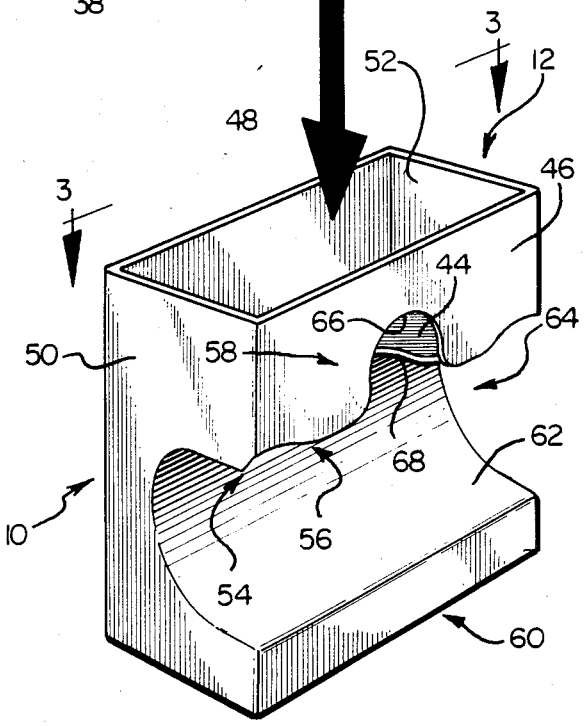
FIG. 3
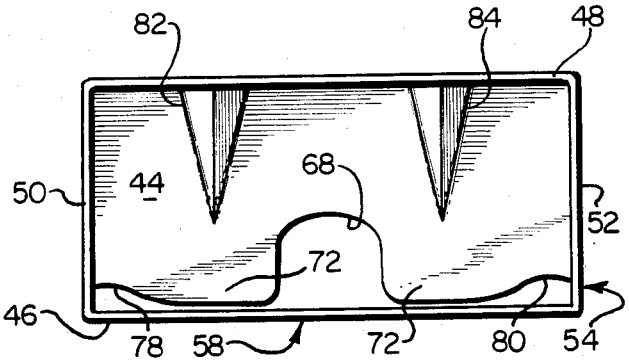

FEEDER DISPENSER FOR NARROW ELONGATED ITEMS

FIELD OF THE INVENTION

This invention relates generally to the packaging arts, more particularly to dispensing packages for consumer products, and especially to means for dispensing narrow elongate consumer items such as drinking straws, cotton swabs, beverage stirrers and the like.

BACKGROUND OF THE INVENTION

Narrow elongate consumer products of the type mentioned above are commonly packaged in lots or groups numbering on the order of from about 50 to 500 individual items. Plastic film "blister" packages and paperboard cartons comprising an open drawer slidably fitted into a rectangularly tubular sleeve are widely used for this purpose; and a major problem with these popular packages resides in their presentation of the items in such an attitude that the critical ends or tips of the items are readily touched by one's fingers in the act of selecting a single item for use, thus destroying the original, sanitary condition of the item.

SUMMARY OF THE INVENTION

The present invention overcomes the aforesaid limitation of the prior art and provides a feeder dispenser in which narrow elongate items are gravity fed to a flexibly lipped discharge port which is open to a restricted mid-portion of the items, for individual extraction, by thumb and forefinger, against a mild resistance.

Accordingly, a general object of the present invention is to provide a new and improved feeder dispenser for sanitary selection of individual, narrow elongate items from a packaged group.

Another object of the invention is to provide a feeder dispenser of the type described which is inexpensive to make and convenient to use.

Yet another object of the invention is to provide a feeder dispenser which admits both thumb and forefinger for grasping the mid-portion of a single, narrow elongate item for extraction from a packaged group.

Additional objects and features of the invention will become apparent from a consideration of the following disclosure.

BRIEF DESCRIPTION OF THE DRAWINGS

In order that the principles of the invention may be readily understood, a single embodiment thereof, applied to a feeder dispenser unit for use with cartons of cotton swabs, but to which the application is not to be restricted, is shown in the accompanying drawings, wherein:

FIG. 1 is a perspective view of a sliding drawer package containing cotton swabs and a cooperating feeder dispenser unit which is constructed in compliance with the present invention to receive a sliding drawer package in assembled relationship for use in delivering individual cotton swab items from the package;

FIG. 2 is a perspective view showing the sliding drawer package and feeder dispenser unit assembled;

FIG. 3 is an enlarged plan view taken substantially along the Line 3—3 of FIG. 1 to show the features of the interior of the bin of the feeder dispenser unit;

DETAILED DESCRIPTION OF THE INVENTION

Figure 6:
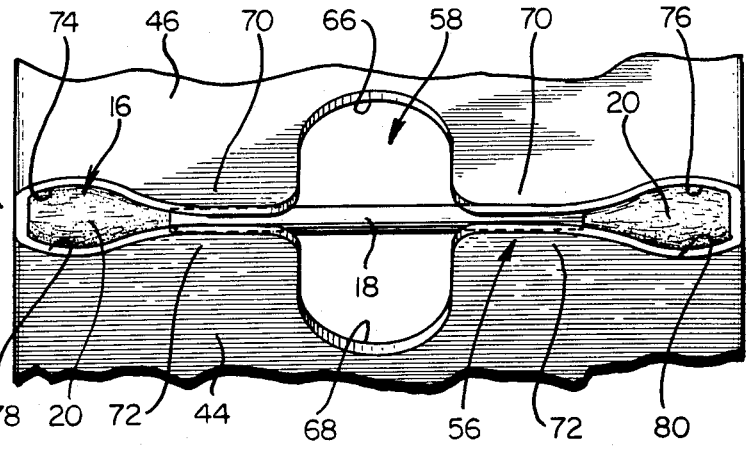
FIG. 6 is a further enlarged view taken substantially along the Line 6—6 of FIG. 4 to show the cooperating digit-access apertures at the discharge port of the feeder dispenser unit.

Referring now in detail to the drawings and giving first attention to FIGS. 1 and 2, a feeder dispenser unit 10 is constructed in compliance with the principles of the present invention to comprise a wall arrangement which defines a rectangular, open top bin 12. The feeder dispenser unit 10 is adapted to be assembled with a conventional sliding drawer or sliding tray, retail package 14, package 14 being adapted to contain a suitable quantity of narrow elongate product items, such as cotton swabs 16, grouped in generally parallel relationship. As is best shown in FIG. 6, each swab 16 comprises a slender rod 18 and a pair of absorbent cotton wads 20 wrapped on the ends of the rod 18.

Returning to FIGS. 1 and 2, the retail package 14 itself includes a rectangularly tubular, packaging sleeve 22 which slidably receives a snugly fitting drawer or tray 24. The tray 24 is fashioned with spaced side walls 26 which are connected by oppositely facing end walls 28, the tray 24 additionally including a floor 30, an open top 32 and, optionally, a medially disposed bulkhead or partition 34. The tray 24 is also sized for snugly telescoping either of its ends into the bin 12 of feeder dispenser unit 10 in order to serve as a feed magazine supplying its contents, specifically the swabs 16, to the feeder dispenser unit.

Advantageously, the side walls 26 of tray 24 are perforated or scored with intersecting lines of weakness 36 and 38, shown in FIG. 1, in order to facilitate removal of the adjacent end wall 28, the adjacent triangular portions 40 and 42 of the side walls 26 and, if desired, the subtended portion of floor 30 prior to assembly of the package 14 and the feeder dispenser unit 10.

The wall arrangement of bin 12 is comprised of four interconnected, upright, planar members and a bottom panel 44, the upright planar members specifically comprising a front panel 46, a back panel 48 and side panels 50 and 52. In addition, the panels 46–52 are carefully spaced to snugly receive one end of the tray 24 after an end wall 28 thereof has been torn off using the weakened lines 36 and 38. In accordance with the principles of the present invention, the bottom panel 44 converges toward the front panel 46 along a common edge region 54 to cooperate in defining an elongate, product-extraction slot 56 and a reach-in-and-take-out port 58, as will be described more fully hereinafter.

Figure 4:
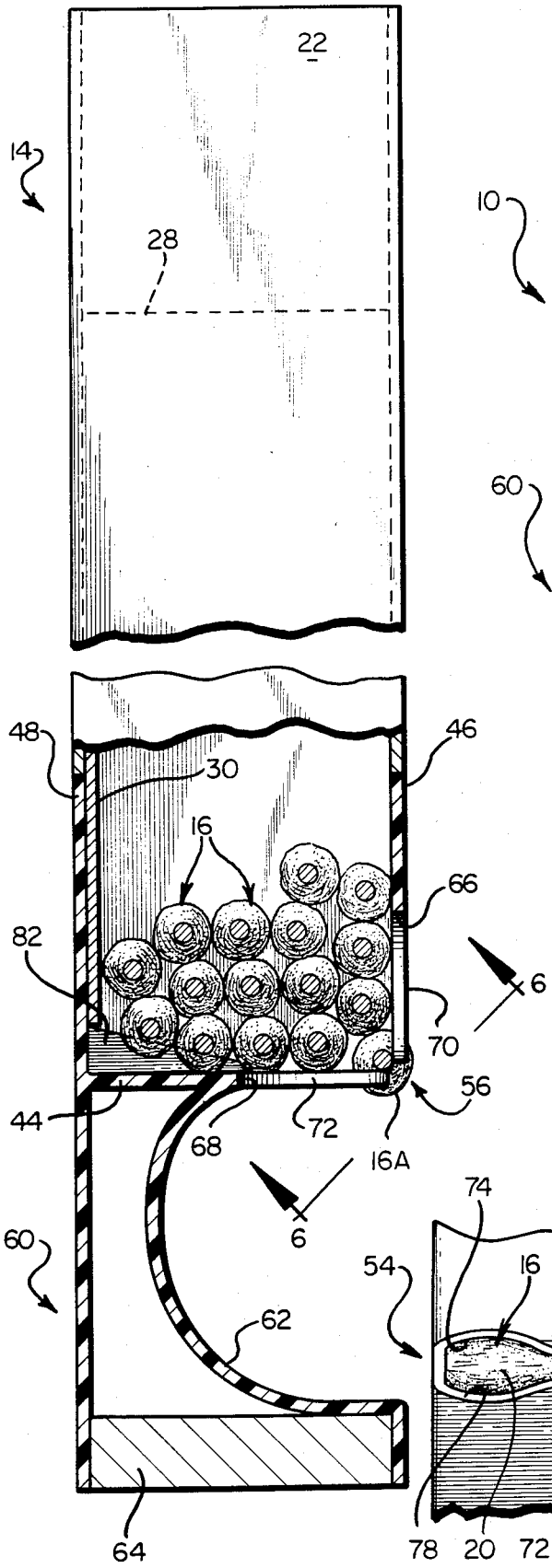
FIG. 4 is an enlarged view, partially in cross-section, taken substantially along the Line 4—4 of FIG. 2 to illustrate gravity feeding of the cotton swabs in the direction of the discharge port of the feeder dispenser unit.

The bin 12 is further intended to be situated in an upstanding attitude on a support surface such as a kitchen or bathroom countertop, a closet or cabinet shelf, or the like. Accordingly, the feeder dispenser unit 10 additionally comprises an L-shaped pedestal 60 which is connected to the bin 12 away from the edge region 54; and the pedestal 60 includes a cylindrical panel 62 which curves away from the bin 12 to allow easy access to the edge region 54, the product-extraction slot 56 and the port 58. In compliance with the features of the invention, a stabilizing weight member 64 is mounted in the base of pedestal 60, as is shown in FIG. 4, to counteract any tipping tendency of the tower-like assembly of the package 14 and the feeder dispenser unit 10.

The feeder dispenser of the present invention is particularly arranged for the discharge port 58 to be open to a restricted mid-portion of the cotton swabs 16 or the like, for individual extraction thereof, as by a person's thumb and forefinger, without touching and contaminating the cotton wads 20. Accordingly and with reference to FIG. 6, the front panel 46 is fashioned with a first, centrally disposed, digit-access aperture 66 which opens into the edge region 54; and bottom panel 44 is provided with a second, centrally disposed, digit-access aperture 68 which opens into the edge region 54 in confluence with the aperture 66 to define the reach-in-and-take-out port 58. In addition, and in order to provide mild resistance to the extraction of the narrow elongate cotton swabs 16, the front panel 46 and the bottom panel 44 include respective, confronting, resilient, thin and flexible lips 70 and 72 which act as spring edges and which are closely spaced apart along the edge region 54 on opposite sides of the port 58 to define the product-extraction slot 56. Advantageously, the lips 70 and 72 are normally disposed in almost-touching relationship whereby to selectively retain the swabs 16 in the bin 12, as is shown in FIG. 4.

In addition, the front panel 46 and the bottom panel 44 are configurated with respective, cooperating, secondary apertures 74, 76 and 78, 80 disposed at the opposite ends of the edge region 54 to pass the bulbous configurations defined by the cotton wads 20.

In compliance with another feature of the invention, the cotton swabs 16 or the like are intended to be primarily gravity fed from the tray 24 to the product-extraction slot 56, with frictional coupling among the swabs 16 cooperating in the delivery action, especially frictional coupling of the swabs immediately adjacent the particular swab being removed at a given instance. In order to enhance delivery of the swabs to the product-extraction slot 56, wedge means comprising a pair of upstanding, pyramidal feed bars 82 and 84 are mounted on the floor panel 44 to extend interiorly of the bin 12 as is shown in FIG. 3. Furthermore and as is shown in FIG. 4, the feed bars 82 and 84 slope downwardly toward the edge region 54 for defining product item feed ramp means.

To use the feeder dispenser 10, the retail package 14 will first be readied by removing any overwrap and by removing one end wall 28 from the carton drawer 24. A short portion of the drawer which is exposed beyond the packaging sleeve 22 will be inserted in the bin 12 of the feeder dispenser, as is suggested by an arrow 90 in FIG. 1.

The assembled package and feeder dispenser will then be disposed upright, as is shown in FIG. 2, on a suitable support surface. In this position, the floor 30 of the carton drawer will rest on the feed bars 82 and 84 and a number of the cotton swabs 16 will be presented at the slot 56, as is shown in FIG. 4, with the flexible lips 70 and 72 resiliently retaining the lead swab, designated 16A, at the extraction slot 56.

Figure 5:
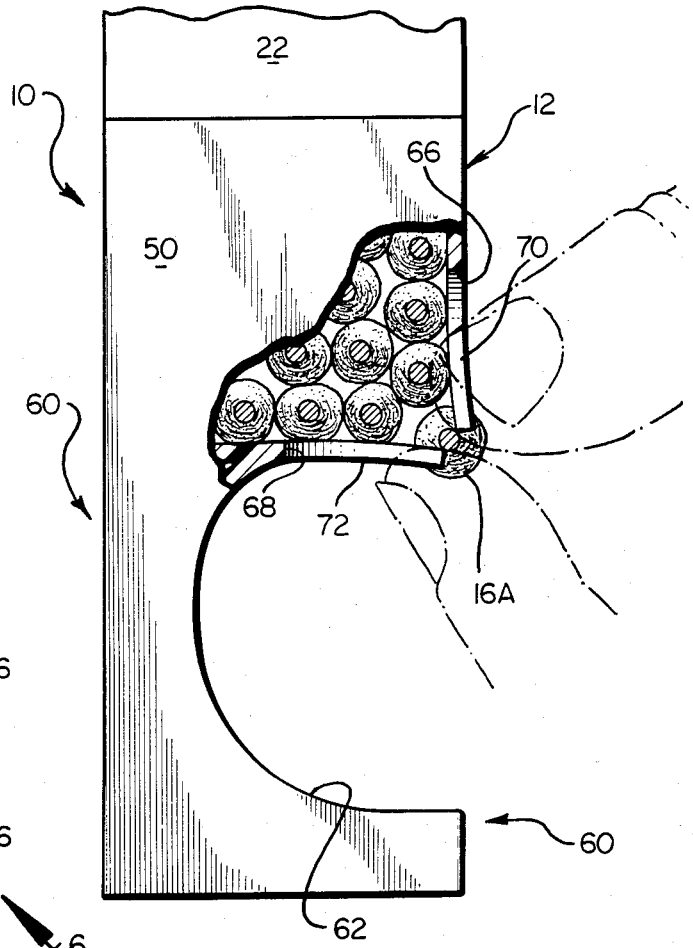
FIG. 5 is a fragmentary view similar to the showing of FIG. 4 but illustrating a person's use of his thumb and forefinger, shown in broken lines, to extract a single cotton swab from the feeder dispenser unit.

To extract the swab 16A, the user will insinuate his thumb and forefinger into the digit-access apertures 66 and 68 respectively, appropriately dimensioned for that purpose, as is suggested in broken lines in FIG. 5, to grasp a mid-portion of the rod 18 of swab 16A away from the cotton wads 20. The swab will then be pulled against the mild resistance of lips 70 and 72 with the wads 20 exiting through the secondary apertures 74, 78 and 76, 80 as is shown in FIG. 6. Touching of the wads 20 by the fingers is actively discouraged by this type of grasping and removal; and the sanitary condition of the wads 20 is therefore preserved.

After the swab 16A has been extracted, the flexible lips 70 and 72 will snap back into the normal position shown in FIG. 4 in order to retain subsequently positioned swabs.

The feeder dispenser of the present invention can be economically fabricated in a plastics injection molding operation and therefore may, if desired, be distributed as a gratuity or as an inexpensive premium. The instant feeder dispenser may also be embodied with an integral magazine in a single retail package. Accordingly, the drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated in the following claims.

The invention is claimed as follows:

1. A feeder dispenser for facilitating one hand extraction of individual, narrow, elongated items from a packaged group comprising:

(a) a rectangular, tubular bin adapted to receive a partially-open package for the dispensible items;

(b) said bin including a solid back wall and opposite side walls, and having a partial front wall and a partial flat bottom wall converging toward a lower common edge;

(c) said front and bottom walls providing confronting separated flexible lips forming therebetween a product extraction slot;

(d) said lips being formed to provide confronting digit access aperture openings defining a reach-in and take-out port congruently with the product extraction slot; and (e) product feeder bars carried by said partial bottom wall within said bin and tapered downwardly in the direction of said extraction slot so as to present a product to be dispensed into said extraction slot.

* * * * *